US008272838B2

(12) United States Patent
Takeuchi et al.

(10) Patent No.: US 8,272,838 B2
(45) Date of Patent: Sep. 25, 2012

(54) IMPELLER AND PUMP INCLUDING THE SAME

(75) Inventors: Kazuki Takeuchi, Hyogo (JP); Hiroshi Kanki, Hyogo (JP); Motonobu Tarui, Hyogo (JP); Nobukazu Tanaka, Hyogo (JP)

(73) Assignee: Shinmaywa Industries, Ltd., Hyogo (JP)

( * ) Notice: Subject to any disclaimer, the term of this patent is extended or adjusted under 35 U.S.C. 154(b) by 563 days.

(21) Appl. No.: 12/510,986

(22) Filed: Jul. 28, 2009

(65) Prior Publication Data

US 2010/0028156 A1 Feb. 4, 2010

(30) Foreign Application Priority Data

Jul. 30, 2008 (JP) ..... 2008-196904

(51) Int. Cl.
*F04D 29/24* (2006.01)

(52) U.S. Cl. ..... 416/19; 416/144; 416/176; 416/185; 416/186 R; 416/242

(58) Field of Classification Search ..... 416/176, 416/177, 178, 182, 185, 186 R, 187, 241 R, 416/242, 243, 223 B
See application file for complete search history.

(56) References Cited

U.S. PATENT DOCUMENTS 4,530,643 A 7/1985 Carlsson

FOREIGN PATENT DOCUMENTS

| | | | | |
|---|---|---|---|---|
| JP | S59-90794 | A | | 5/1984 |
| JP | 10-238495 | A | | 9/1998 |
| JP | 2002202092 | A | * | 7/2002 |
| JP | 2004-218574 | A | | 8/2004 |
| JP | 2005240763 | A | * | 9/2005 |
| JP | 2005240764 | A | * | 9/2005 |
| JP | 2006-90279 | A | | 4/2006 |
| JP | 2006132432 | A | * | 5/2006 |
| JP | 2006291938 | A | * | 10/2006 |
| JP | 2007-255324 | A | | 10/2007 |
| JP | 2008-82305 | A | | 4/2008 |

* cited by examiner

*Primary Examiner* — Igor Kershteyn
(74) *Attorney, Agent, or Firm* — Roberts Mlotkowski Safran & Cole P.C.

(57) ABSTRACT

An impeller includes an impeller body which rotates about a rotation axis, and a vane which is provided at the impeller body. The impeller body receives force asymmetric with respect to the rotation axis in driving and rotation in a fluid in a manner that radially inward fluid force, which is generated due to arrangement of the vane, acts on a predetermined point in a peripheral direction. In the impeller body, a filled space filled, in a fluid, with the fluid is formed.

9 Claims, 11 Drawing Sheets

IMPELLER AND PUMP INCLUDING THE SAME

BACKGROUND

The present disclosure relates widely to pump impellers and pumps including such impellers.

Centrifugal pumps may be used as pumps for conveying swage and the like. As an impeller included in such a centrifugal pump, Japanese Unexamined Patent Application Publication 2007-255324 discloses a non-clogging type impeller causing less clog even if it sucks swage including, for example, solid contaminants. Inside the impeller, a one-piece vane forms a flow path connecting an inlet opening at one end surface of the impeller to an outlet opening at the peripheral surface thereof.

SUMMARY

One example impeller includes an impeller body which rotates about a rotation axis; and a vane which is provided at the impeller body, wherein the impeller body receives force asymmetric with respect to the rotation axis in driving and rotation in a fluid in a manner that radially inward fluid force, which is generated due to arrangement of the vane, acts on a predetermined point in a peripheral direction, a filled space filled, in a fluid, with the fluid is formed in the impeller body, and when the impeller body is driven and rotated in the fluid, centrifugal force acting on the fluid filled in the filled space cancels the fluid force acting on the impeller body.

DETAILED DESCRIPTION

Figure 1:
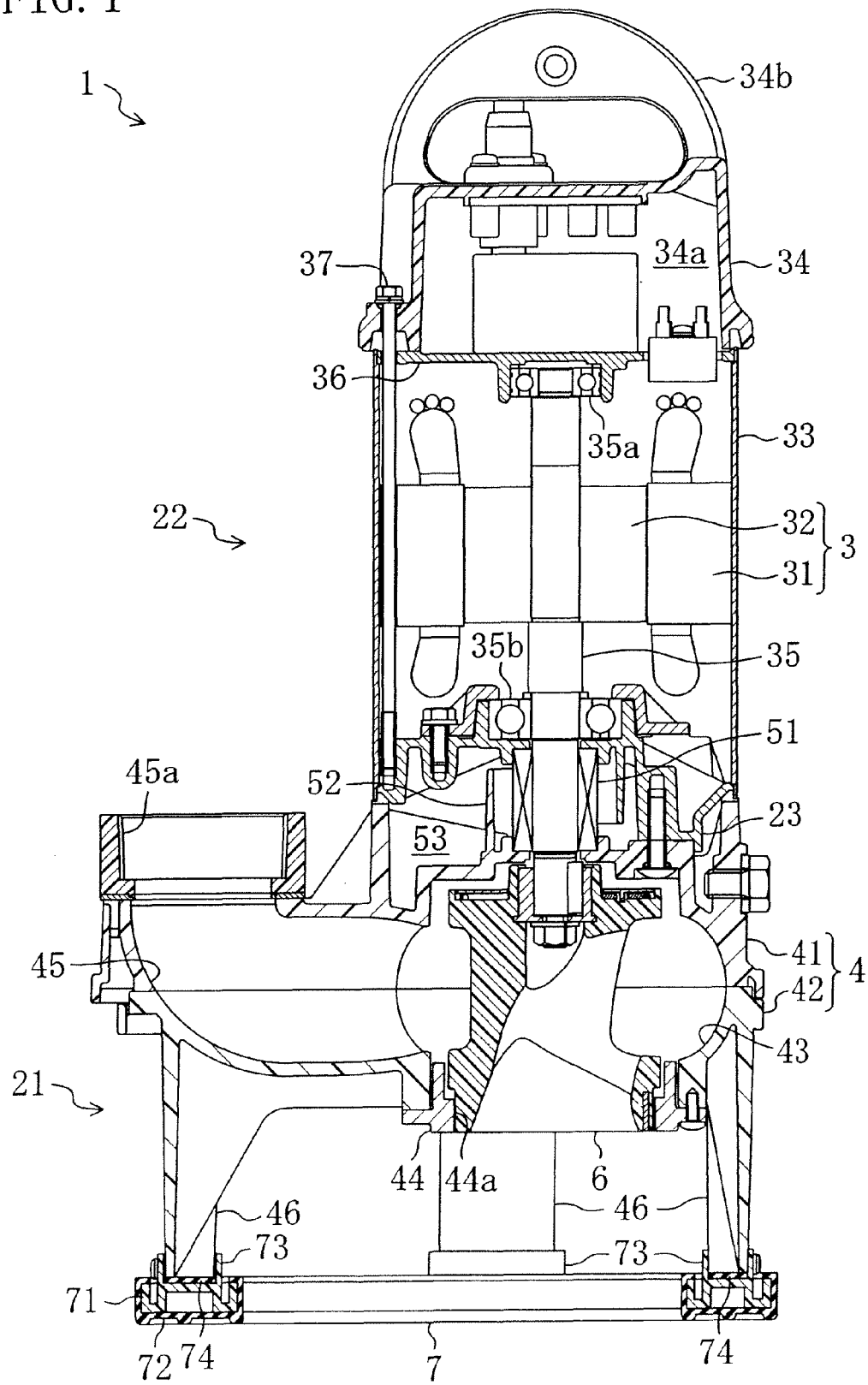
FIG. 1 is a cross-sectional view of a submerged pump including an example impeller.

Impellers with one-piece vanes have asymmetric shapes with respect to their rotation axes. For this reason, the impeller disclosed in the above document has a hollow for achieving a static balance in a resting state and a dynamic balance in rotation in the air (hereinafter collectively referred to as a mechanical balance). In order to prevent damage to a pump at a confirmation test after pump installation and in no-load operation (e.g., the pump is activated erroneously in spite of the fact that there is no pumping fluid), it is necessary to achieve the mechanical balance in the air.

In general, impellers receive radially inward forces from fluid caused by suction (negative pressure) in actual driving of pumps (hereinafter this resultant force is also referred to forces as a fluid force). However, in the impeller with a one-piece vane as disclosed in the above document, the fluid force acts asymmetrically with respect to the rotation axis. For this reason, a balance (a hydraulic balance) in driving and rotation in the fluid must be ensured. Accordingly, the impeller disclosed in the above document includes a weight at a flange part for obtaining the hydraulic balance.

However, the present inventors then noticed that the weight in the impeller can loose the mechanical balance in the air. In other words, it is difficult for the impeller disclosed in the document to achieve both the mechanical balance in the air and the hydraulic balance in the fluid.

The present inventors further noticed that improvement in efficiency of the impeller relatively increases the fluid force acting on the impeller where the suction (negative pressure) becomes large, thereby significantly loosing the hydraulic balance. In this case, where a relatively large weight is provided to the impeller for achieving the hydraulic balance, the mechanical balance can be lost then. From this, it was found that the higher the efficiency of the impeller becomes, the more difficult it is to achieve both the mechanical balance and the hydraulic balance in fluid.

The technique disclosed herein is directed to a pump with an impeller including: an impeller body which rotates about a rotation axis; and a vane which is provided at the impeller body, wherein the impeller body receives force asymmetric with respect to the rotation axis in driving and rotation in a fluid in a manner that radially inward fluid force, which is generated due to arrangement of the vane, acts on a predetermined point in a peripheral direction, a filled space filled, in a fluid, with the fluid is formed in the impeller body, and when the impeller body is driven and rotated in the fluid, centrifugal force acting on the fluid filled in the filled space cancels the fluid force acting on the impeller body.

By the above configuration, the fluid force asymmetric with respect to the rotation axis caused due to arrangement of the vane acts on the impeller body. When the impeller body, which includes the filled space, rotates in the fluid, the centrifugal force acting on the fluid filled in the filled space can cancel the fluid force. Thus, the balance (the hydraulic balance) where the impeller is driven and rotated in the fluid can be obtained.

By contrast, when the impeller body is place in the air and rotate, the fluid in the filled space is discharged to be evacuate from the space. By configuring the vane in advance so that the impeller body can achieve the static balance and the dynamic balance in this evacuated state, the mechanical balance in the air can be achieved.

Thus, in the impeller, the filled space is evacuated in the air and is filled with the fluid in the fluid. This can provide an advantage in obtaining both the mechanical balance in the air and the hydraulic balance in the fluid.

The impeller body may be divided into one side and the other side by a plane which is orthogonal to a plane passing through both the point of application of the fluid force and the rotation axis and which passes through the rotation axis, and the filled space may be formed in the side where the fluid force acts out of the one side and the other side of the rotation axis in the impeller body.

That is, the fluid force acts on one of the one side and the other side which are divided by the virtual plane passing through the rotation axis. This causes the direction of the radially inward fluid force acting on the impeller body to be reverse to the direction of the radially outward centrifugal force acting on the fluid in the filled space, thereby allowing the two forces to cancel each other. This is advantages in achieving the hydraulic balance of the impeller in the fluid.

The filled space may extends in a peripheral direction so as to surround the rotation axis, and in the impeller body, defining walls may be formed which define the filled space so that an angle range in the peripheral direction of the filled space has a predetermined range.

By this configuration, the fluid in the filled space (i.e., a weight where the centrifugal force acts) can be arranged over a necessary angle range in the peripheral direction in the impeller body. This can achieve the hydraulic balance in the fluid.

The angle range of the filled space may be larger than 180 degrees.

If the angle point of the fluid force acting on the impeller body stays at the same point and does not vary, the filled space may be formed to have an angle range of, for example, 180 degrees in the side where the fluid force acts out of the one side and the other side of the rotation axis in the impeller body. This can cause the direction of the centrifugal force acting on the fluid filled in the filled space to be reverse to the direction of the fluid force, thereby ensuring cancellation of the fluid force.

However, as the discharge flow rate of a pump with the impeller varies, the angle point of the fluid force acting on the impeller body varies. Therefore, when the angle range where the fluid is filled is increased by increasing the angle range where the filled space is formed more than 180 degrees, the centrifugal force in the direction that can cancel the fluid force can be generated even when the angle point where the fluid force acts varies. In other words, the angle range of 180 degrees or larger where the filled space is formed is advantageous in achieving the hydraulic balance of the impeller body in the fluid over a wide discharge flow rate range of the pump.

The configuration of the impeller body (e.g., the number of vanes, its type, such as non-clogging type, etc.) is not limited specifically as long as the radially inward fluid force acts asymmetrically with respect to the rotation axis.

The filled space may be opened to the impeller body.

The impeller body may have a substantially cylindrical shape including one end and another end surfaces in directions normal to the rotation axis, and a peripheral surface between the one end and another end surfaces, and the vane may be a one-piece vane in which an inner channel connecting an inlet opening at the one end surface to an outlet opening at the peripheral surface is formed.

An impeller with such a one-piece vane cannot achieve the hydraulic balance in the fluid as it is, in addition to non-achievement of the mechanical balance in the air, because the fluid force acts asymmetrically. However, formation of the filled space can achieve both the mechanical balance of the impeller in the air and the hydraulic balance thereof in the fluid. Thus, the above configuration is advantages for impellers with one-piece vanes.

The filled space may be opened at the another end surface of the impeller body, and is recessed in an axial direction of the rotation axis, and the impeller further including a lid which closes the opening of the filled space by being mounted on the another end surface of the impeller body, wherein in the lid, a through hole may be formed which communicates with the filled space, and which allows fluid to flow into the filled space in the fluid and to discharge out the fluid in the filled space in the air.

Direct exposure of the opening of the filled space to the other end surface of the impeller body may increase a dynamic loss caused by fluid disturbance, and makes it difficult to stably generate the centrifugal force by filling the fluid in the filled space. For this reason, it is preferable to flatten the other end surface of the impeller body by mounting a lid.

In addition, a through hole formed in the lid can allow the fluid to flow into the filled space through the through hole in the fluid even when the lid closes the opening of the filled space. On the other hand, the fluid in the filled space can be discharged through the through hole in the air.

The example pump includes the above pump impeller, a casing housing the pump impeller, and a drive source driving and rotating the pump impeller. By this configuration, both the mechanical balance of the impeller in the air and the hydraulic balance thereof in the fluid can be achieved.

Example embodiments will be described below with reference to the accompanying drawings. It is noted that the following embodiments are merely preferred example. FIG. 1 shows a submerged pump 1 with an example impeller. The submerged pump 1 includes a pump section 21 including an impeller 6, and a motor section 22 including a motor 3 driving the impeller 6. In the submerged pump 1, the pump section 21 and the motor section 22 are disposed below and above an oil casing 23, respectively, so that the pump section 21 and the motor section 22 are arranged side by side in the vertical direction. It is noted that this submerged pump 1 is of light-weight type in which a head cover 34 and a pump casing 4, which will be described later, are made of a predetermined resin material.

The motor section 22 includes the motor 3 including a stator 31 and a rotor 32, a stator casing 33 covering the stator 31 of the motor 3, and the head cover 34 mounted at the upper end of the stator casing 33. A rotary shaft 35 of the motor 3 extends vertically.

The stator casing 33 has a substantially cylindrical shape whose both ends are opened. The upper end opening of the stator casing 33 is closed by a motor cover 36. The motor cover 36 includes at its lower surface a bearing 35*a* rotatably supporting the upper end of the rotary shaft 35.

The head cover 34 is mounted at the upper end of the stator casing 33. The head cover 34 includes an upper wall and a peripheral wall extending downward from the peripheral edge of the upper wall and fixed to the upper end of the stator casing 33. The head cover 34 is in a reverse U-shape in cross-section. Accordingly, a combination of the head cover 34 with the motor cover 36 forms in its inside a housing space 34*a* for housing various electrical components. A cable boots through which an electric supply cable supplying electricity to the motor 3 is mounted at and inserted in the upper wall of the head cover 34. A handle 34*b* is mounted at the central part on the upper surface of the upper wall of the head cover 34. The head cover 34 is fixed to the oil casing 23 by means of a plurality of bolts 37 (only one is shown in the drawing) arranged at predetermined intervals in the peripheral direction. In other words, the bolts 37 passing through through holes formed in the peripheral part of the head cover 34 pass through the motor cover 36, extend downward along the inner peripheral surface of the stator casing 33, and are screwed into the peripheral part of the oil casing 23. Thus, in the submerged pump 1, the vertically extending long bolts 37 fixes the head cover 34, the stator casing 33, and the motor cover 36 together to the oil casing 23. This configuration can reduce the number of components of the submerged pump 1 and man power for assembly.

The oil casing 23 is mounted at the lower end of the stator casing 33, and closes the lower end opening of the stator casing 33. A pump casing 4 is mounted at the lower end of the oil casing 23. The oil casing 23 defines and forms together with the pump casing 4 an oil chamber 53 in which lubricant oil is filled. In the oil casing 23, a through hole through which the rotary shaft 35 of the motor 3 is inserted is formed. A bearing 35*b* rotatably supporting the intermediate part of the rotary shaft 35 is mounted on the upper surface of the oil casing 23. In the oil chamber 53 defined by and formed with the oil casing 23 and the pump casing 4, a mechanical shaft seal 51 seals the rotary shaft 35, and an annular wall 52 surrounding the entirety of the outer periphery of the mechanical shaft seal 51 is provided.

The pump section 21 includes the impeller 6 mounted at the lower end of the rotary shaft 35 of the motor 3, and the pump casing 4. The submerged pump 1 is a centrifugal pump. The pump casing 4 is configured by integrating an upper first pump casing 41, which defines and forms the oil chamber 53 together with the oil casing 23, with a lower second casing 42 by welding. Integration by welding the first pump casing 41 to second pump casing 42 can eliminates the need to provide a flange necessitated for integrating two pump casings with each other by fastening with bolts and nuts, thereby downsizing the submerged pump 1.

In the upper part of the pump casing 4, a through hole through which the rotary shaft 35 is inserted is formed, and a volute casing 43 for housing the impeller 6 is formed. On the other hand, the lower part of the pump casing 4 is opened downward. To this opening, a liner ring 44 including an opening 44*a* for supporting a wearing ring 692 forming the lower end part of the impeller 6 is mounted. Further, at the side part of the pump casing 4, a discharge portion 45 is integrally formed which protrudes laterally and curved upward. The discharge portion 45 communicates with the volute chamber 43, and includes a discharge port 45*a* opened upward. The discharge port 45*a* is coupled to a discharge pipe not shown. Downwardly extending four legs 46 (only three of them are shown in FIG. 1) are provided at predetermined locations of the lower part of the pump casing 4. The lower ends of the legs 46 are mounted and fixed to a stand 7. The stand 7 includes a main body 71 made of synthetic resin and a rubber cover 72 covering the lower part of the main body 71. An inserted portion 73 in which the lower ends of the legs 46 are received and fixed with screws protrudes upward and is integrally formed at the main body 71. Between the lower surfaces of the legs 46 and the inserted portion 73, a damping rubber or steel plate 74 is interposed. In the stand 7, the cover 72 functions to prevent the submerge pump 1 from being displaced, and the damping rubber or steel plate 74 functions to damp the vibration of the submerged pump 1 in driving.

Figure 3:
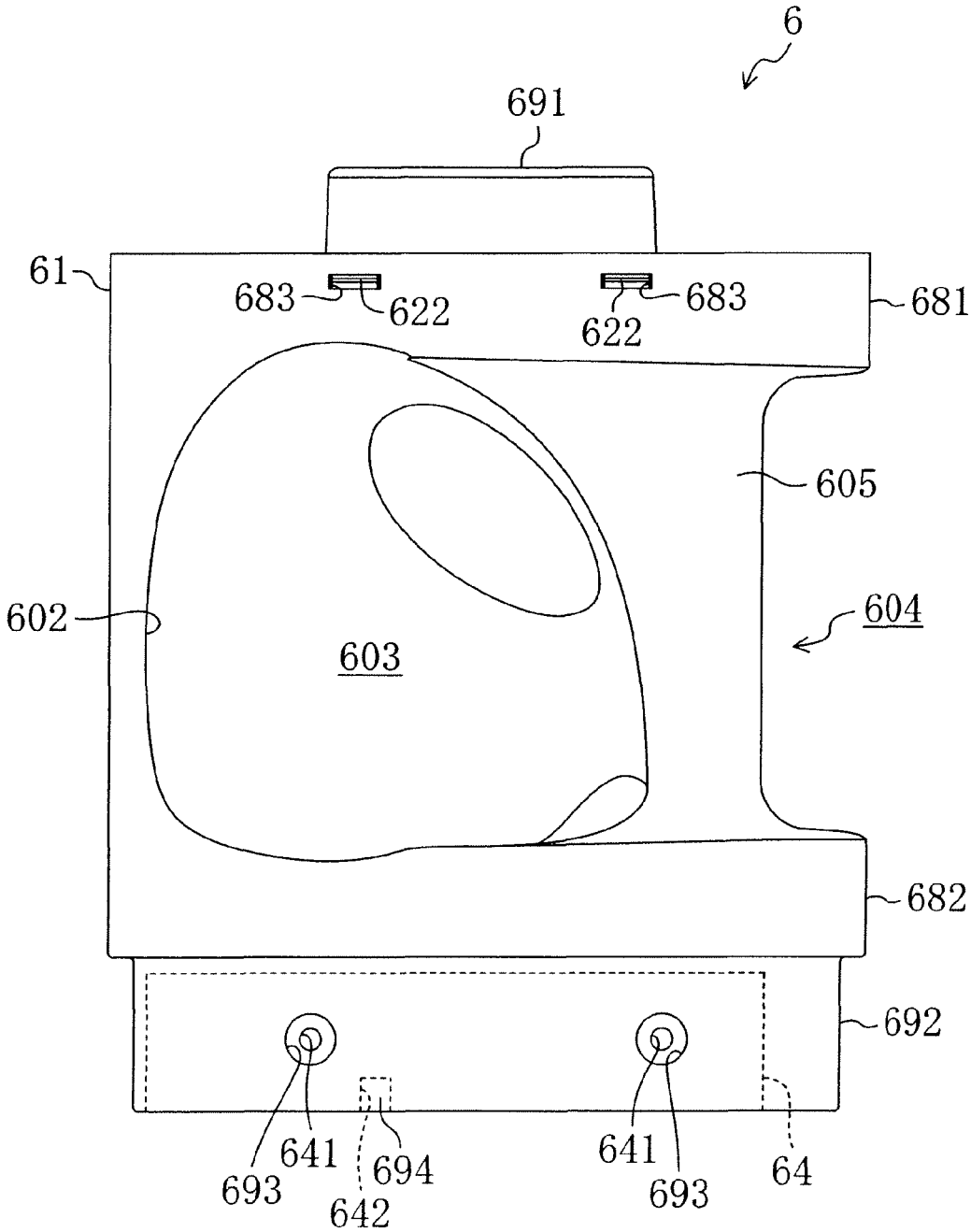
FIG. 3 is a front view of the impeller.
Figure 4:
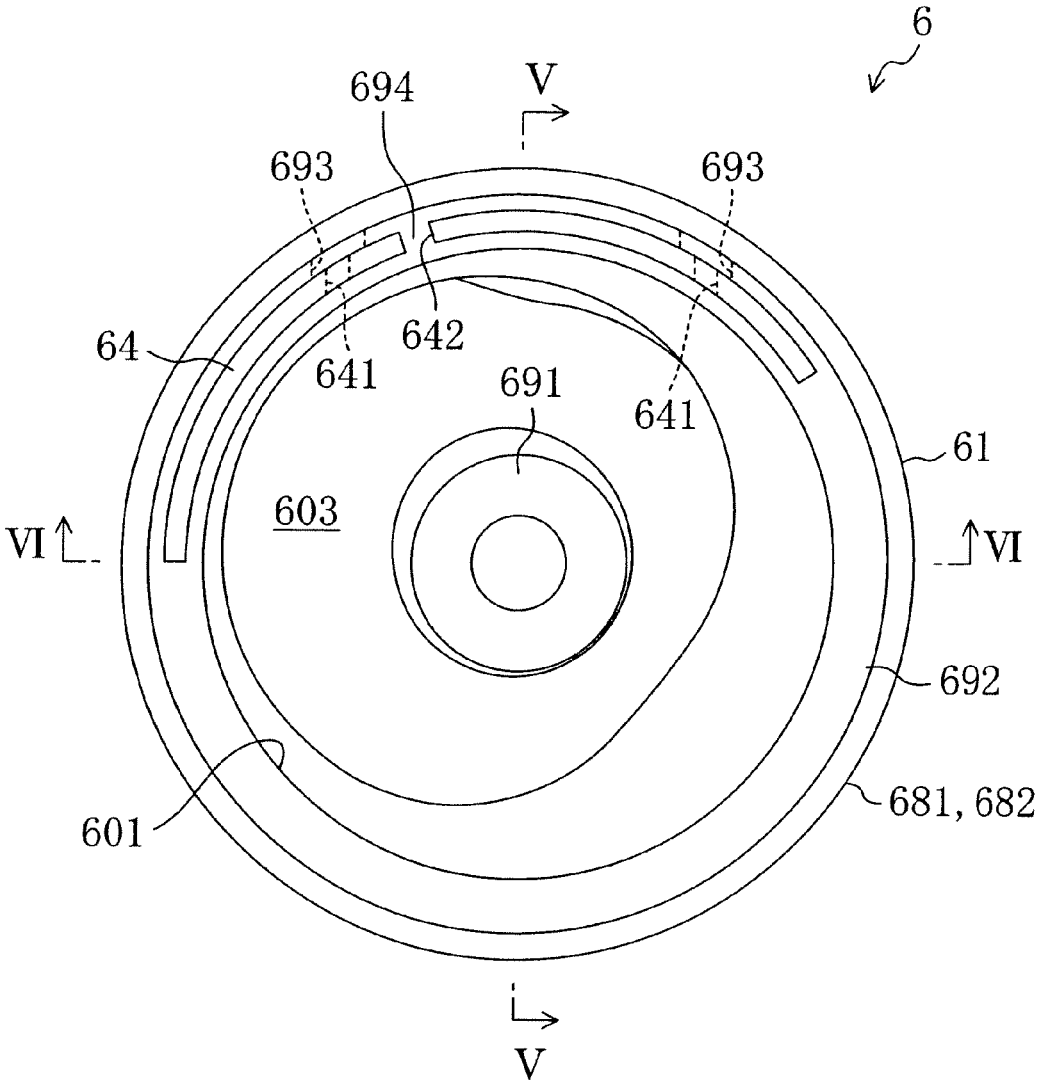
FIG. 4 is a bottom view of the impeller.
Figure 5:
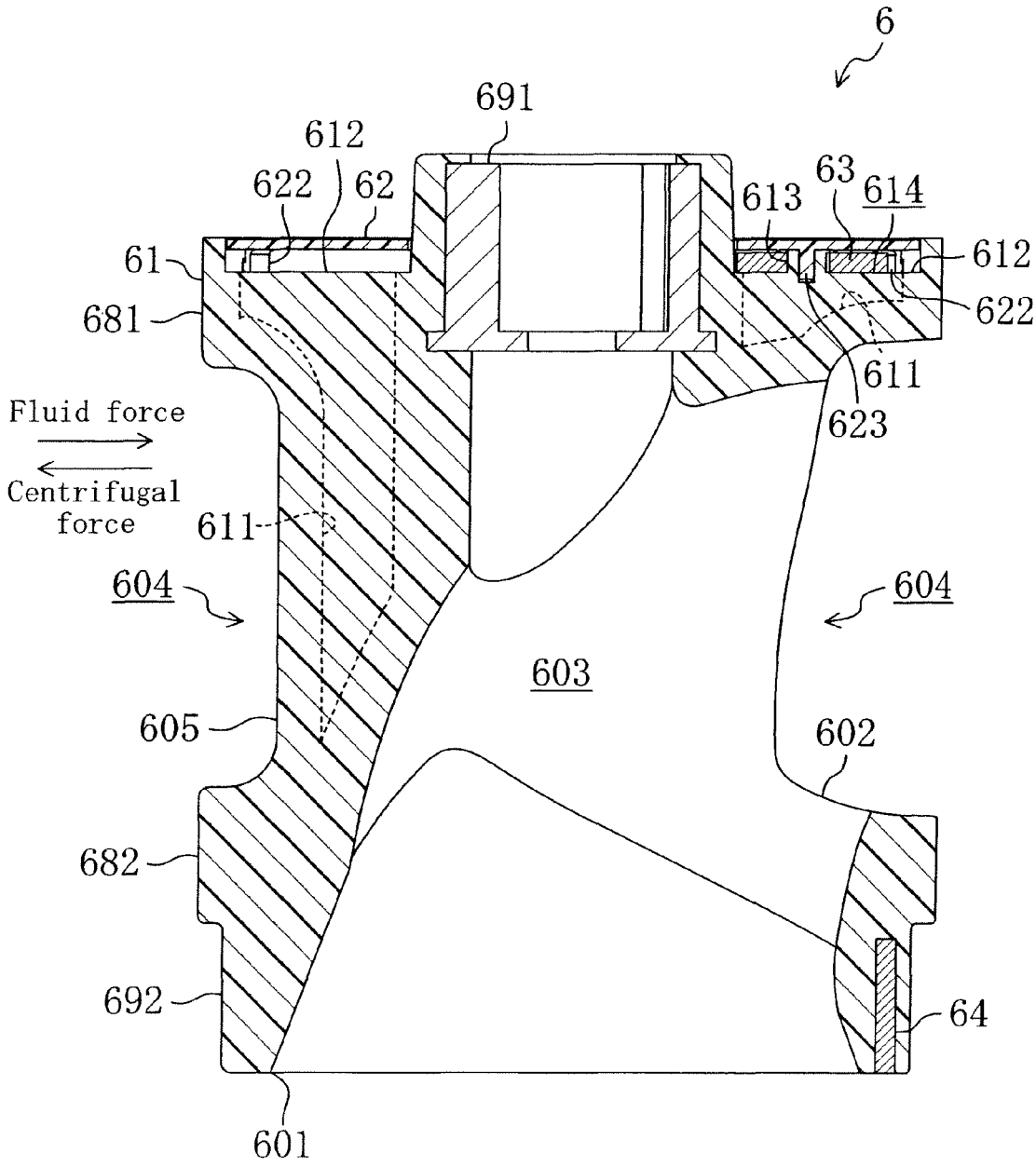
FIG. 5 is a cross-sectional view taken along the line V-V in FIG. 4.

As shown in FIGS. 2 to 6, the impeller 6 herein is a non-clogging type impeller in a substantially cylindrical shape. The impeller 6 is fixed to the lower end of the rotary shaft 35 so that its cylinder axis is coaxial with the rotary shaft 35 (see FIG. 1). The impeller 6 includes and configured by an impeller body 61 and a lid 62 mounted at the upper end surface of the impeller body 61. Further, the impeller 6 includes an upper balance weight 63 and a lower balance weight 64 mainly for the purpose of obtaining the mechanical balance in the air. Though it will be described later in detail, the upper balance weight 63 is arranged and fixed between the impeller body 61 and the lid 62, and the lower balance weight 64 is embedded in the wearing ring 692 of the impeller body 61, as shown in FIG. 5. In addition, though it will be described later in detail, a recess 611 (a filled space) is formed in the impeller body 61 mainly for the purpose of obtaining the hydraulic balance in fluid.

The impeller body 61 has a substantially cylindrical shape. A downwardly opening inlet 601 is formed in the lower end surface of the impeller body 61. On the other hand, a laterally opening outlet 602 is formed at a predetermined location in the peripheral surface of the impeller body 61. Further, an internal channel 603 extending in the cylinder axial direction is formed inside the impeller 6. The inner channel 603 connects the inlet 601 to the outlet 602. An outer channel 604 recessed inward in the radial direction is formed in the outer peripheral surface of the impeller body 61. The outer channel 604 is not a channel extending in the cylinder axial direction. The channel center of the outer channel 604 is located on a plane orthogonal to the cylinder axis of the impeller body 61. The outer channel 604 continues from the downstream side of the inner channel 603 at the outlet 602, and peripherally extends along almost the entire circumference of the impeller 6. The outer channel 604 is defined by a vane 605. The vane 605 is generally-called a one-piece vane (a centrifugal vane) of radial flow type. The vane 605 increases the pressure of water in the external channel 604, thereby discharging the water to the outer peripheral side (outward in the radial direction). It is noted that the vane 605 also defines the inner channel 603 on its inner peripheral side. The impeller 6 in which the inner channel 603 and the outer channel 604 are thus formed can exhibit high efficiency when compared with conventional impellers.

In the upper part of the outer channel 604, a first flange 681 protrudes outward along the entire periphery of the impeller body 61. Similarly, a second flange 682 protruding outward in the radial direction along the entire periphery thereof is formed in the lower part of the outer channel 604. The second flange 682 transversely partitions the impeller 6 into a lower part in which the inlet 601 is formed and an upper part in which the outlet 602 is formed. That is, the impeller 6 is a closed type impeller in which the inlet 601 and the outlet 602 are partitioned by the second flange 682. Further, a shaft support portion 691 protrudes upward at the central part of the upper end surface of the impeller body 61 which is located on the upper side of the first flange 681. The shaft support portion 691 is made of a predetermined metal material, and has a mounting hole through and to which the rotary shaft 35 of the motor 3 is inserted and fixed. In the impeller body 61, the wearing ring 692 inserted in the opening 44*a* of the pump casing 4 protrudes downward on the lower side of the second flange 682.

Figure 6:
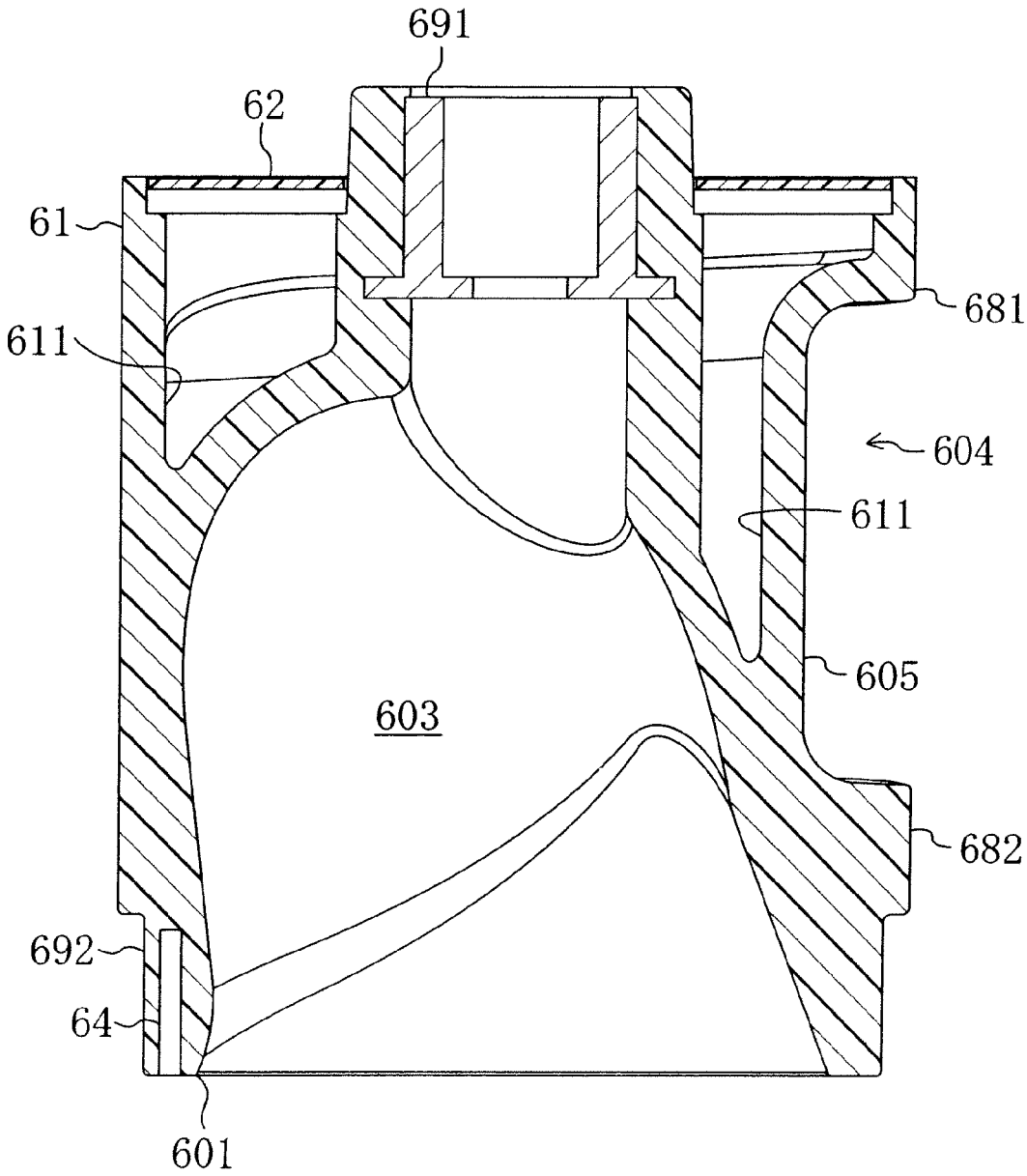
FIG. 6 is a cross-sectional view taken along the line VI-VI in FIG. 4.

Here, in order to reduce required power of the submerged pump 1, the diameters of the first and second flanges 681, 682 are set small so that the diameter of the impeller body 61 is small as far as possible. This shows a design in which a little step difference is formed between the second flange 682 and the wearing ring 692, as shown in FIGS. 3, 5, and 6. It is noted that the diameters of the first and second flanges 681, 682 may be further reduced so as to eliminate this step difference, for example. Conversely, the step difference between the second flange 682 and the wearing ring 692 may be eliminated by increasing the diameter of the wearing ring 692 so as to increase the diameter of the inlet 601.

Figure 7:
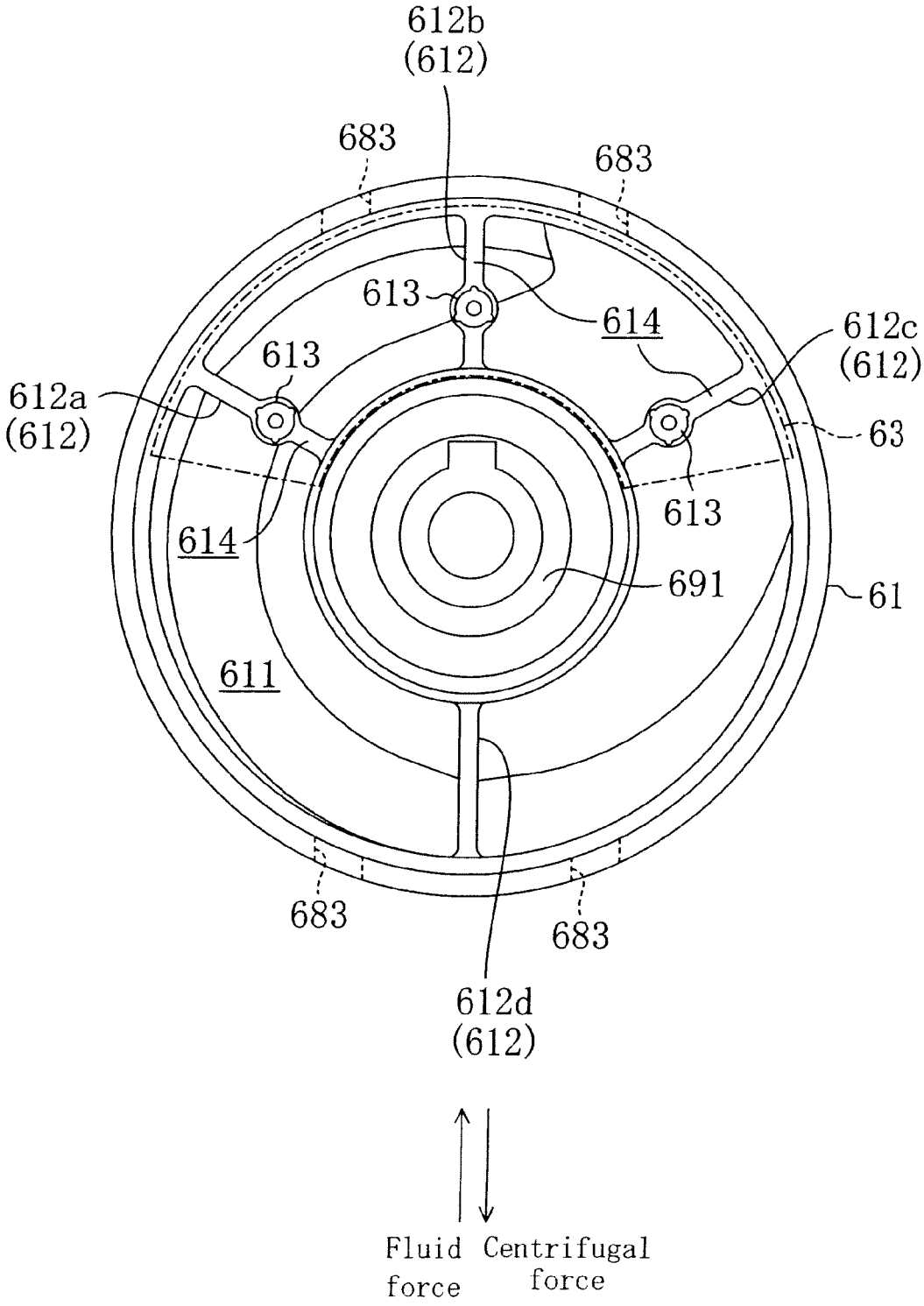
FIG. 7 is a plan view of an impeller body where a lid is taken away.

As shown in FIGS. 5 to 7, a recess 611 is formed which is recessed in the cylinder axial direction from the upper end surface of the impeller body 61. The recess 611 extends in the peripheral direction along the entire periphery of the upper end surface in the impeller body 61 so as to surround the cylinder axis. Further, the recess 611 is relatively shallow on the open side (right in FIG. 5) of the outlet 602, and relatively deep on the side (left in FIG. 5) opposite to the open side of the outlet 602, a shown in FIGS. 5 and 6. When the impeller 6 is submerged in water, the recess functions as a filled space with which the fluid is filled.

Further, at the upper end of the impeller body 61, reinforcing ribs 621 are formed which extend in the radial direction to couple the shaft support portion 691 to the peripheral edge of the impeller body 61. In the impeller body 61 of the present example embodiment shown in FIG. 7, first to third three reinforcing ribs 612*a*, 612*b*, 612*b* are formed at predetermined angle intervals in the upper half region corresponding to the open side of the outlet 602. On the other hand, one reinforcing rib (a fourth rib 612*d*) is formed in the lower half region corresponding to the opposite side of the outlet 602 to the open side. Of the four reinforcing ribs 612, first and third reinforcing ribs 612*a*, 612*c* function as defining walls defining the filled space extending in the peripheral direction so that the filled space has a predetermined angle range. That is, the reinforcing ribs 612 extends from the opening to bottom of the recess 611 in the cylinder axial direction, as shown in, for example, FIG. 5, to partition the recess 611 into a plurality of regions in the peripheral direction. In the recess 611 partitioned into the plurality of regions, part located on the opposite side of the outlet 602 to the open side and defined by the relatively deep part of the recess 611 (between the first and third reinforcing ribs 612*a*, 612*c*) functions as the filled space. It is noted that the fourth reinforcing rib 612*d* functions as a reinforcing rib for the impeller body 61, and does not define the filled space. The filled space configured by the recess 611 extends across an angle range of approximately 240 degrees on the opposite side of the outlet 602 to the open side.

Figure 11:
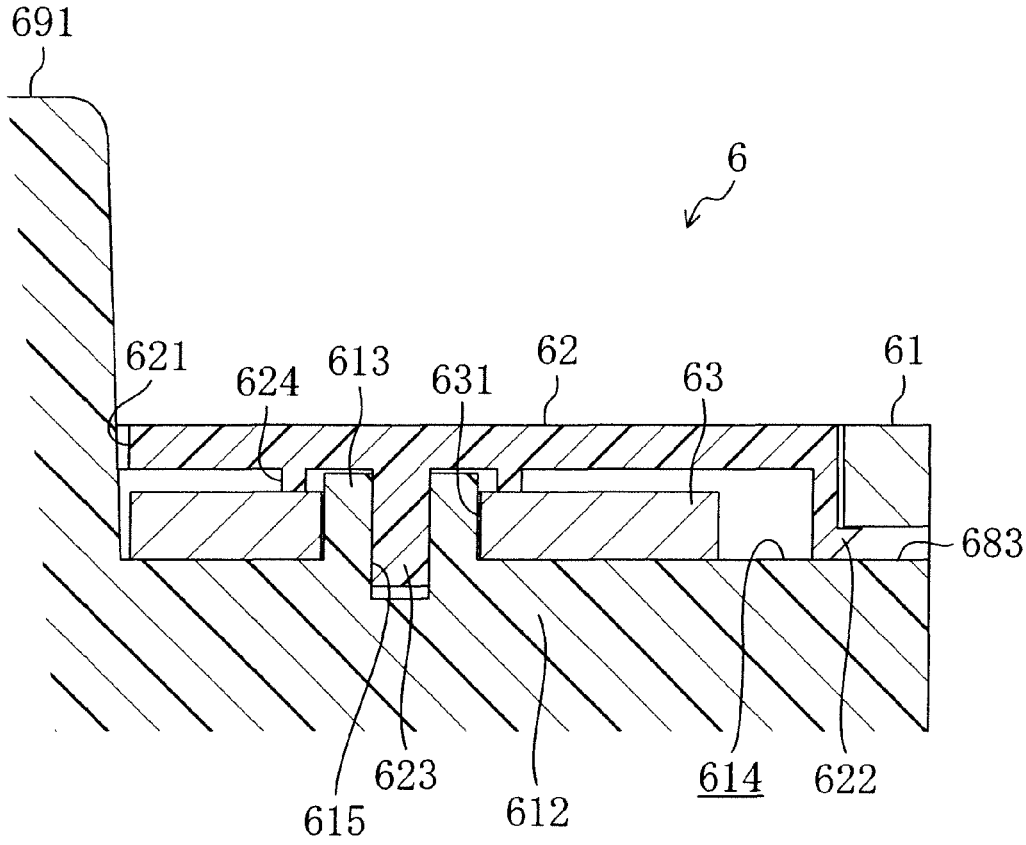
FIG. 11 is an enlarged cross-sectional view showing the vicinity of the boss of the impeller body.

The first to third three reinforcing ribs 612*a*, 612*b*, 612*c* disposed on the open side of the outlet 602 also function as a stage on which the upper balance weight 63 is placed, as shown in FIG. 11 and the like. In other words, the upper end surfaces of the reinforcing ribs 612*a*, 612*b*, 612*c* of the impeller body 61 function as a stage surface 614 on which the upper balance weight 63 is placed. Further, bosses 613 for fixing the upper balance weight 63 are formed at approximate centers in the radial direction of the reinforcing ribs 612*a*, 612*b*, 612*c*.

Figure 10:
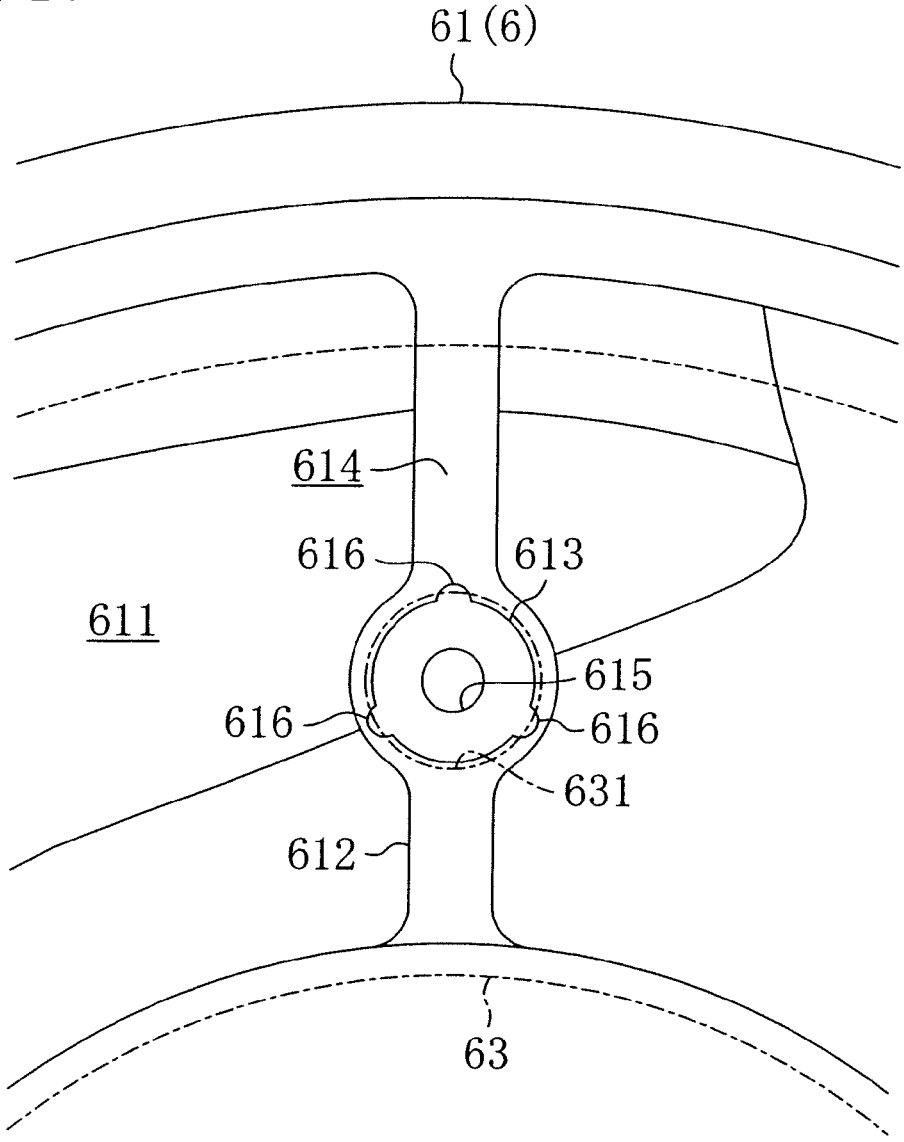
FIG. 10 is an enlarged plan view showing the vicinity of a boss of the impeller body.

As shown in FIGS. 10 and 11, the bosses 613 are parts having a circular shape when viewed from above and having a diameter larger than the width of the ribs 612. At their centers, pin holes 615 opening upward and extending in the cylinder axial direction are formed. Three protrusions 616 protruding outward in the radial direction are formed integrally with each of the bosses 613 at equal intervals in the peripheral direction in the outer peripheral surfaces of the bosses 613.

Figure 12:
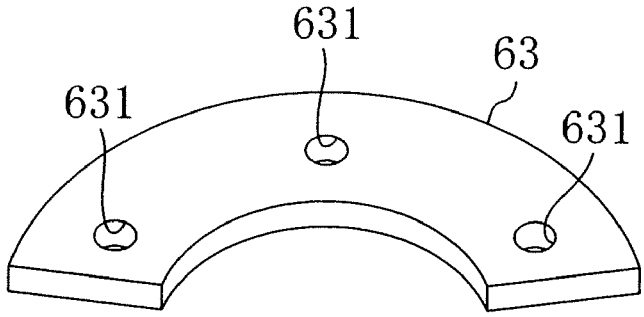
FIG. 12 is a perspective view of an upper balance weight.

As discussed above, the upper balance weight 63 is a weight mounted to the impeller body 61 for obtaining the mechanical balance, and is made of a predetermined metal material. The upper balance weight 63 has a substantially fan shape as if it is obtained by cutting out only a predetermined angle range from a disc plate with a predetermined thickness, as shown in FIG. 12. The upper balance weight 63 has a large horizontal shape having a width in the radial direction larger than the thickness in the cylinder axial direction (vertical direction). The upper balance weight 63 is disposed between the shaft support portion 691 and the peripheral part of the impeller body 61, as shown in FIG. 7. Accordingly, its inner diameter is larger than the diameter of the shaft support portion 691. On the other hand, its outer diameter is smaller than the diameter of the peripheral part of the impeller body 61. It is noted that the shape of the upper balance weight 63 is not specifically limited, and can be appropriately set so that necessary weight can be ensured within the limitation that the upper balance weight 63 is disposed between the impeller body 61 and the lid 62.

Three holes 631 are formed in the upper balance weight 63 so as to correspond to the three bosses 613, and pass through the upper balance weight 63 in the thickness direction. The holes are external holes 631 external to the bosses 613. As shown in FIG. 10, their hole diameter is larger than the diameter of the bosses 613 and smaller than the diameter of circles connecting the distal ends of the protrusions 616.

The upper balance weight 63 is placed on the stage 614 of the reinforcing ribs 612 so that the external holes 631 are external to the bosses 613, as shown in an enlarged scale in FIGS. 10 and 11. This positions the upper balance weight 63 on the open side of the outlet 602 on the upper end surface of the impeller body 61. Thus, the upper balance weight 63 in relation to the mechanical balance can be accurately positioned on the opposite side (upper side) of the rotation axis to the part (lower side in FIG. 7) functioning as the filled space. Further, the upper balance weight 63 covers the upper end opening of the recess 611 on the open side of the outlet 602. Thus, inflow of the fluid into this part can be suppressed. Here, the diameter of the external holes 631 of the upper balance weight 63 is larger than the diameter of the bosses 613 and smaller than the circles connecting the distal ends of the protrusions 616. When parts of the protrusions 616 are crushed, the external holes are external to the bosses 613. This can reduce wobbling of the upper balance weight 63.

Figure 8:
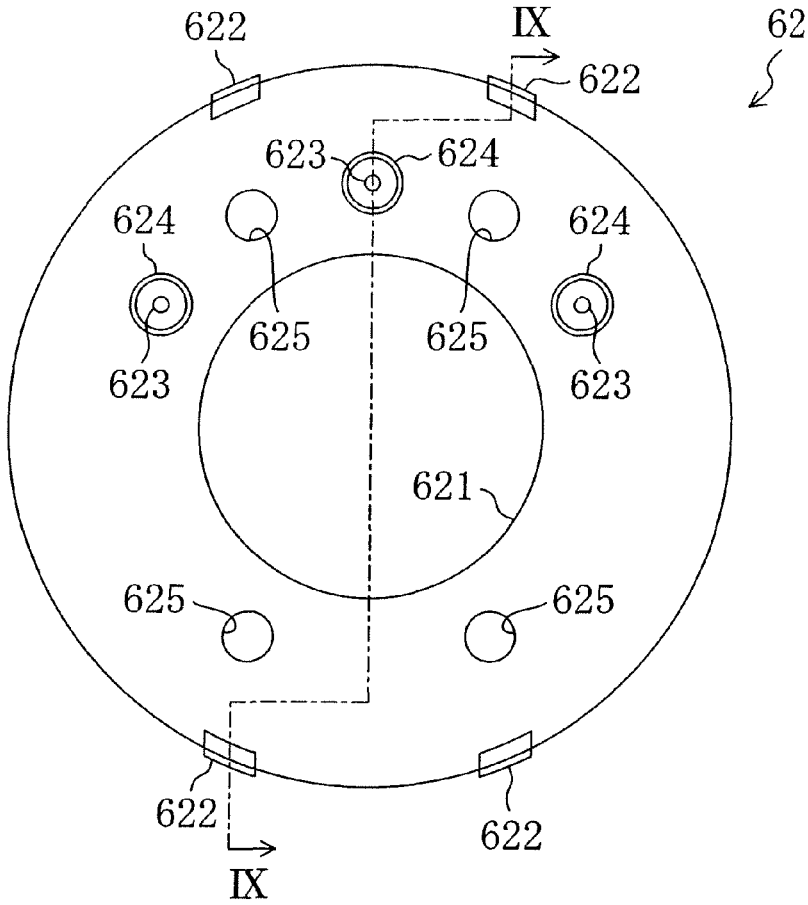
FIG. 8 is an illustration showing a reverse surface of the lid.
Figure 9:
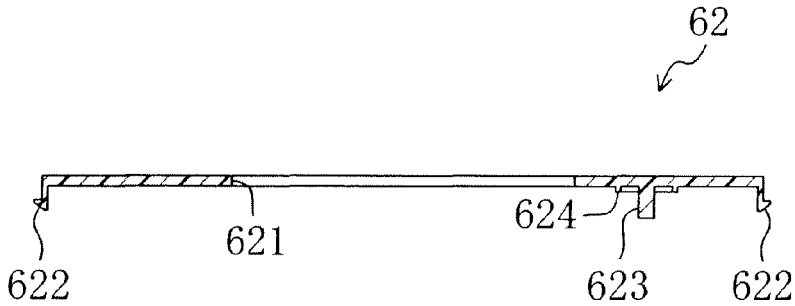
FIG. 9 is a cross-sectional view taken along the line IX-IX in FIG. 8.

As shown in FIGS. 8 and 9, the lid 62 has a disc shape, and has a central part in which a through hole 621 receiving the shaft support portion 691 of the impeller body 61 is inserted. When the lid 62 is mounted on the upper end surface of the impeller body 61, the opening of the recess 611 is closed to flatten the upper end surface of the impeller body 61. This is advantageous in preventing an increase in power loss caused by fluid turbulence.

The lid 62 is made of, for example, synthetic resin, and has a flat surface. Further, two elastic engaging claws 622 are formed integrally with the lid 62 at a predetermined intervals in the peripheral direction at parts of the peripheral part on a side corresponding to the opening of the outlet 602 and on the opposite side of the cylinder axis to the side. The elastic engaging claws 622 are claws engaged with engaging grooves 683 formed in the peripheral part of the upper end part of the impeller body 61. The elastic engaging claws 622 and the engaging grooves 683 configure engaging means that mounts and fixes the lid 62 to the impeller body 61. Since the lid 62 is mounted and fixed to the impeller body 61 by engaging the elastic engaging claws 622 with the engaging groove 683, no tools for assembly work may be necessary, thereby facilitating assembly of the impeller 6.

Three fitting pins 623 protrude from the reverse surface of the lid 62 at locations corresponding to the bosses 613 of the impeller body 61. When the lid 62 is mounted to the impeller body 61, the fitting pins 623 are inserted in the pin holes 651 formed in the bosses 613. Thus, the lid 62 can be further stably mounted and fixed to the impeller body 61 by inserting the fitting pins 623 into pin holes 615 in addition to engagement of the elastic engaging claws 622 with the engaging grooves 683. Further, pressers 624 for pressing the upper balance weight 63 protrude from the reverse surface of the lid 62. The pressers 624 are formed in a ring shape so as to surround the fitting pins 623. Accordingly, when the lid 62 is mounted and fixed to the impeller body 61, as shown in FIG. 11, the lower surfaces of the pressers 624 presses downward the upper surface of the upper balance weight 63 at the peripheral parts of the bosses 613. In this way, the upper balance weight 63 is held between the lid 62 and the impeller body 61. Accordingly, as will be described later, the upper balance weight 63 can be fixed at the same time that the lid 62 is mounted to the impeller body 61, thereby further facilitating assembly work of the impeller 6.

Furthermore, four through holes 625 are formed in the lid 62 two by two in the open side of the outlet 63 and the opposite side thereto. The through holes 625 communicate with the recess 611 when the lid 62 is mounted to the impeller body 61. When the impeller 6 is submerged in water (which is accompanied by installation of the submerged pump 1 or water level rise in the installed submerged pump 1), the fluid flows into the recess 611 (the filled space) through the through holes 625. At this time, the upper balance weight 63 is disposed in the part (upper side in FIG. 7) of the recess 611 which does not function as the filled space, as described above, thereby suppressing inflow of the fluid to this part. In the present example embodiment, in the case where the part of the recess 611 which does not function as the filled space must be filled with the fluid for the purpose of achieving a predetermined distribution in the peripheral direction of the centrifugal force acting on the fluid in the recess 611, through holes communicating with the through holes 625 of the lid 62 may be formed in the upper balance weight 63. In this way, the fluid may be filled in the entire peripheral part of the recess 611.

By contrast, when the impeller 6 is raised from the fluid, and is driven and rotated in the air, the fluid in the recess 611 is discharged outside through the through holes 625. Preferably, a plurality of the through holes 625 are formed in the outer peripheral part in the radial direction of the lid 62 as far as possible. This can ensure discharge of the fluid in the recess 611 to the outside, and ensure inflow of the fluid into the recess 611 (especially, the filled space). It is noted that the through holes 625 herein are, but not limited to be, formed symmetric with respect to the center axis of the lid 62, and may be formed appropriately. However, it is further preferable to form the through holes 625 with weight balance of the lid 62 taken into consideration.

Figure 13:
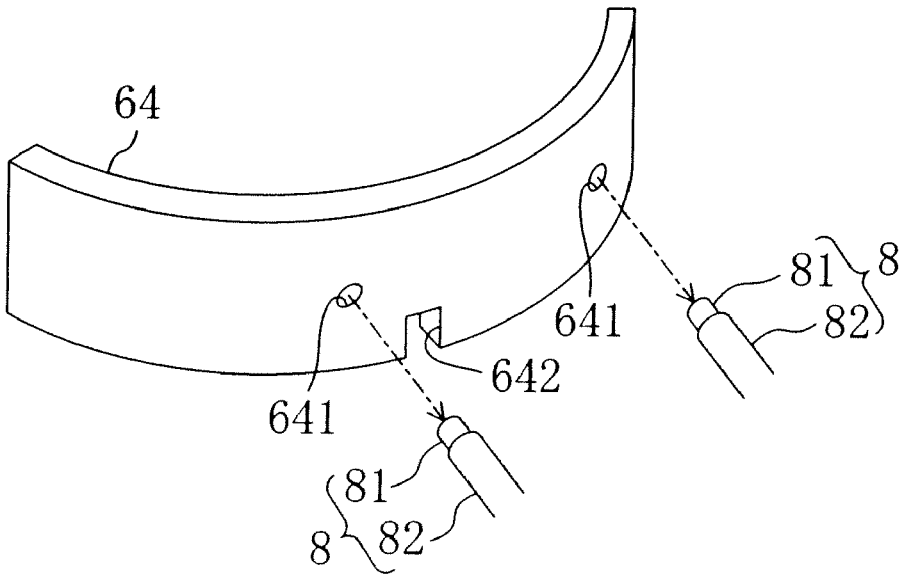
FIG. 13 is a perspective view of a lower balance weight.

The lower balance weight 64 is embedded in the wearing ring 692 on the open side of the outlet 602 of the impeller body 61, as shown in FIGS. 3 and 4. The lower balance weight 64, which is made of a predetermined metal material, is a plate piece curved in an arc shape, as shown in FIG. 13 and the like, and has a vertical shape having a height larger than the thickness in its radial direction. The lower balance weight 64 is embedded in the wearing ring 692 so as to be exposed at its lower end surface to the lower end surface of the impeller body 61, as shown in FIG. 4. Two through holes 641 are formed at predetermined locations in the lower balance weight 94, and functions as a positioning holes receiving positioning pins 8 of a mold. A notch 642 is formed at the central part of the lower end part of the lower balance weight 64. With the notch 642, resin is filled in the notch 642 in molding the impeller body 61. This configures a stopper 694 crossing in the thickness direction in the lower balance weight 64, as shown in FIG. 4. Thus, the lower balance weight 64 is in the vertical shape unlike the upper balance weight 63. Accordingly, it can be embedded in the radially thin wearing ring 692. Embedding the upper balance weight 64 in the impeller body 61 can eliminate the need to mount a balance weight to the second flange 682. This can increase the diameter of the inlet 601 of the impeller 6 as much as possible, thereby ensuring a predetermined passage characteristics for foreign matter, and can reduce the diameters of the first and second flanges 681, 682 as far as possible, thereby reducing the diameter of the impeller 6. Thus, a reduction in power of the submerged pump 1 can be achieved.

Next, an impeller body 61 manufacturing sequence will be described briefly. Here, assume that the impeller body 61 is made of synthetic resin. First, the shaft support portion 691 and the lower balance weight 64 are disposed at predetermined locations in a mold (not shown). At this time, the two positioning pins 8 define the position in the peripheral direction and inclination of the lower balance weight 64, as shown in FIG. 13. Further, the positioning pins 8 have small diameter portions 81 at their distal ends and large diameter portions 82 at their base ends. The position in the radial direction of the lower balance weight 64 is defined by the step differences between these diameters. Thus, the lower balance weight 64 can be accurately positioned at a predetermined location in the mold. This can ensure that the lower balance weight 64 is embedded in the thin wearing ring 692 of the impeller body 61.

Figure 2:
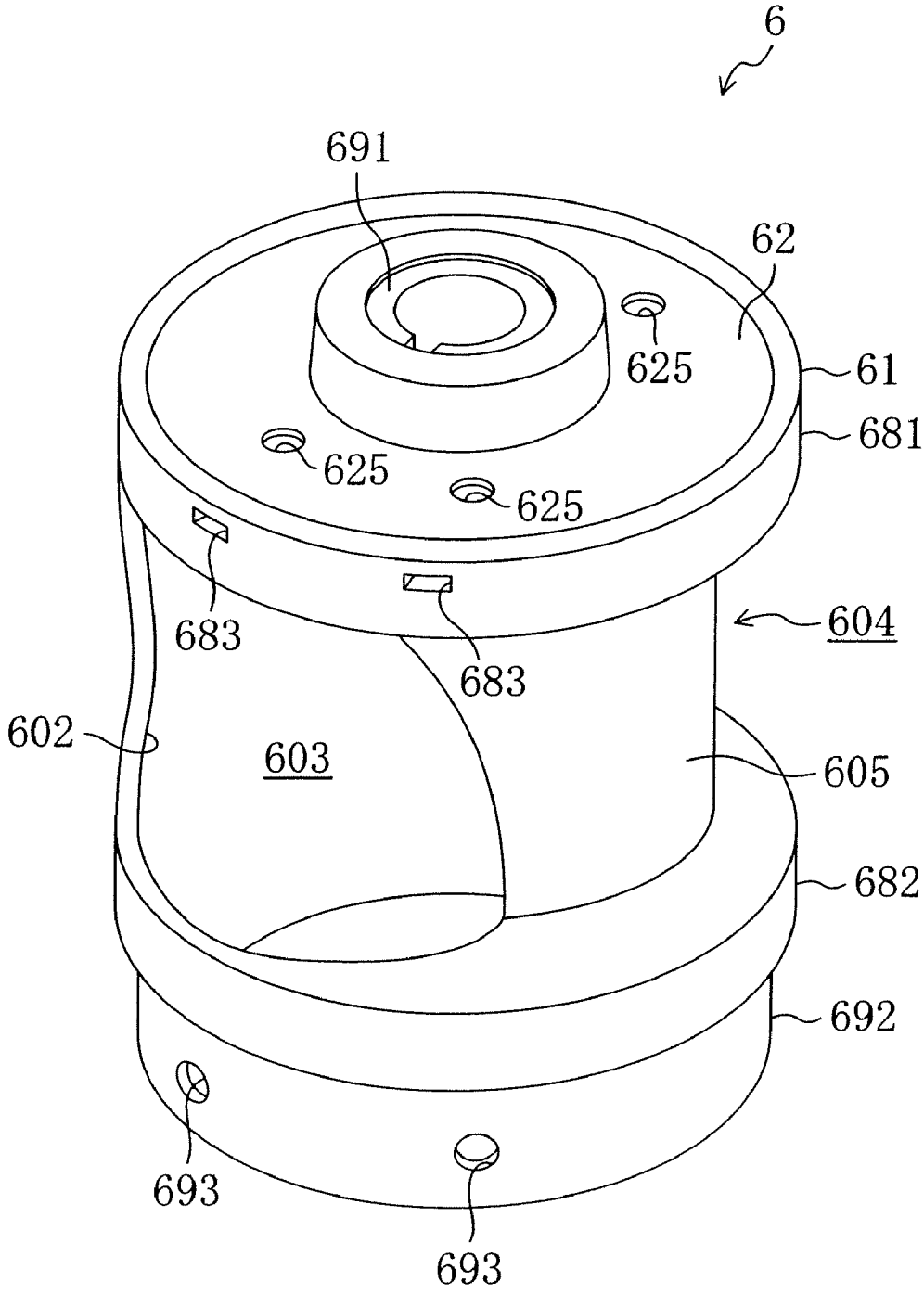
FIG. 2 is a perspective view of the impeller.

Subsequently, the impeller body 61 is molded by known resin molding. In the wearing ring 692 of the impeller body 61 thus molded, holes 693 by the positioning pins 8 are formed, as shown in FIGS. 2 and 3.

Next, the upper balance weight 63, which has been prepared separately, is mounted on the upper end surface of the molded impeller body 61. The upper balance weight 63 is mounted so that the external holes 631 are external to the bosses 613 by crushing the protrusions 616 of the bosses 613, as discussed above.

Thereafter, the lid 62, which has been molded separately, is mounted to the impeller body 61. At this time, the fitting pins 623 of the lid 62 are fit into the pin holes 615 of the impeller body 61, and the elastic engaging claws 622 of the lid 62 are elastically deformed to be engaged with the engaging grooves 683 of the impeller body 61. Thus, the lid 62 is mounted and fixed to the impeller body 61, while at the same time the pressers 624 of the lid 62 press the upper balance weight 63, thereby completing mounting the upper balance weight 63 to the impeller body 61.

Thus, the upper balance weight 63 and the lower balance weight 64 can provide the static and dynamic balances of the impeller 6, thereby achieving the mechanical balance in the air. This can permit the impeller 6 to be smoothly driven and rotated in the air without vibration and the like even when the submerged pump 1 including the impeller 6 with this configuration is driven in the air, for example, for a confirmation test after pump installation and in no-load operation (e.g., the pump is driven erroneously in spite of the fact that there is no pumping fluid, etc.). Thus, the pump 1 can be prevented from being damaged.

When the impeller 6 is submerged by installing the submerged pump 1 in water or by raising the fluid level after installation, the fluid flows into the recess 611 through the through holes 625 formed in the lid 62, as described above, thereby filling especially the filled space with the fluid.

When the submerged pump 1 is driven to rotate the impeller 6 in this state, the fluid force acting on the impeller 6 and the centrifugal force acting on the fluid in the filled space cancel each other, thereby achieving hydraulic balance.

Specifically, by negative pressure generated by sucking the fluid into the inner channel 603 of the impeller 6, the radially inward fluid force acts on a peripheral part on the side opposite to the open side of the outlet 602, as shown in FIGS. 5 and 7.

By contrast, the filled space of the impeller 6 is filled with the fluid. Accordingly, the radially outward centrifugal force acts on the filled fluid in driving and rotating the impeller 6. Since the filled space of the recess 661 is formed on the side opposite to the open side of the outlet 602, as discussed above, the centrifugal force acts radially outward on the peripheral part on the side opposite to the open side of the outlet 602 (see the arrows in FIGS. 5 and 7).

Accordingly, the fluid force and the centrifugal force in the reverse directions cancel each other, thereby achieving hydraulic balance of the impeller 6 in the fluid.

Moreover, when the submerged pump 1 is raised from the water and is driven in the air, rotation of the impeller 6 accompanies discharge of the fluid in the recess 611 through the through holes 625 of the lid 62, thereby evacuating the recess 611. Accordingly, as described above, the upper balance weight 63 and the lower balance weight 64 can provide the mechanical balance. Therefore, the impeller 6 can be driven and rotated stably also in the air.

Thus, the filled space of the impeller 6 is evacuated in the air, and is filled with the fluid in fluid. This is advantageous in achieving both the mechanical balance in the air and the hydraulic balance in fluid.

Furthermore, the above configuration can provide the hydraulic balance over a wide flow rate range of the submerged pump 1 by setting the angle range of the filled space at approximately 240 degrees, that is, to be equal to or larger than 180 degrees. In other words, variation in discharge flow rate of the submerged pump 1 accompanies variation in angle point of the fluid force acting on the impeller 6 (the fluid force acting perpendicularly upward in FIG. 7 on the angle point corresponding to the lowest end of the impeller body 61 will act aslant at a location displaced from the angle point in FIG. 7). By contrast, by setting in advance the angle range of the filled space to be equal to or larger than 180 degrees, the centrifugal force in the direction reverse to the fluid force after the angle point varies can be generated. Thus, even when the angle point of the fluid force varies, the fluid force can be cancelled, thereby achieving the hydraulic balance over the wide flow rate range of the submerged pump 1.

The magnitude and angle point of the fluid force acting on the impeller 6 vary according to the discharge flow rate of the submerged pump 1. However, the depth of the recess 611 functioning as the filled space and the angle range in the peripheral direction defined by the reinforcing ribs 612*a*, 612*c*, that is, the volume of the filled space can be set at designing the submerged pump 1 so as to obtain the centrifugal force equal to or larger than and reverse to the fluid force acting on the impeller 6 according to the magnitude and angle point of the fluid force. Specifically, it may be set so that the mass necessary as the mass of the fluid filled in the recess 611 can be secured at a desired angle point.

Here, the recess 611 is formed along the entire periphery of the impeller body 61, and the reinforcing ribs 612*a*, 612*c* define the angle range functioning as the filled space. Alternatively, the recess 611 may be formed only in the angle range functioning as the filled space, and is not formed in the other angle range not functioning as the filled space (part on the upper side of the part defined by the first and third reinforcing ribs 612*a*, 612*c* in FIG. 7). As a scheme for not forming the recess 611 in this way, such the part is made thick in advance so as not to form the recess. Alternatively, the recess 611 may be filled later, which means no recess formed. For example, a balance weight may be disposed in the recess 611 to fill the recess 611.

Conversely, the recess 611 may be formed along the entire periphery, and the reinforcing ribs may not define the angle range functioning as the filled space. Specifically, the weight distribution in the peripheral direction of the fluid filled in the recess 611 may be appropriately set by differentiating between the depth at part on the open side of the outlet 602 and that at part on the opposite side thereto in the recess 611, or the like so that the distribution of the centrifugal force acting on the fluid can cancel the fluid force. In other words, the defining walls or the like defining the angle range in the peripheral direction of the filled space are dispensable.

Furthermore, the configuration of the defining walls is not limited to the reinforcing ribs 612. Further, the defining walls are not limited in a radially linearly extending shape, and may be curved.

It is noted that the filled space is not limited to be opened at the upper end surface of the impeller body 61, and may be opened at any surface thereof other than the upper end surface.

In addition, the impeller is not limited to a synthetic resin impeller. Further, the impeller is not limited to an impeller with a one-piece vane. The present technique is applicable to impellers with two or more vanes. In other words, if the hydraulic balance of an impeller with two or more vanes cannot be obtained in water, the filled space may be formed in the impeller. Further, the type of the impeller is not limited to any specific type.

The invention claimed is:

1. An impeller, comprising:

an impeller body which rotates about a rotation axis; and a vane and an outlet which are provided at the impeller body, wherein the impeller body receives force asymmetric with respect to the rotation axis in driving and rotation in a fluid in a manner that radially inward fluid force, which is generated due to arrangement of the vane, acts on a predetermined point in a peripheral direction, a hollow space formed in the impeller body and completely surrounded by circumferential wall portions having no openings, at least part of the hollow space being opposite to the outlet that fills with fluid such that when the impeller body is driven and rotated in the fluid centrifugal force acting on the fluid filled space cancels the fluid force acting on the impeller body thereby balancing the impeller about its rotation axis when the impeller body is driven and rotated in the fluid, and in an evacuated state in which the fluid is evacuated from the filled space, the impeller is balanced about its rotation axis so as to have static balance in a resting state and dynamic balance in a rotating state when the impeller body is driven and rotated in air.

2. The impeller of claim 1, wherein the fluid force acts on one of one side and another side of the rotation axis of the impeller body, and the filled space is formed on one of the sides on which the fluid force acts out of the one side and the another side of the rotation axis of the impeller body.

3. The impeller of claim 1, wherein the filled space extends in a peripheral direction so as to surround the rotation axis, and in the impeller body, defining walls are formed which define the filled space so that an angle range in the peripheral direction of the filled space has a predetermined range.

4. The impeller of claim 3, wherein the angle range of the filled space is larger than 180 degrees.

5. The impeller of claim 1, wherein the filled space is opened at the impeller body.

6. The impeller of claim 1, wherein the impeller body has a substantially cylindrical shape including one end and another end surfaces in directions normal to the rotation axis, and a peripheral surface between the one end and another end surfaces, and the vane is a one-piece vane in which an inner channel connecting an inlet opening at the one end surface to an outlet opening at the peripheral surface is formed.

7. The impeller of claim 6, wherein the filled space is opened at the another end surface of the impeller body, and is recessed in an axial direction of the rotation axis, the impeller further comprising a lid which closes the opening of the filled space by being mounted on the another end surface of the impeller body, wherein in the lid, a through hole is formed which communicates with the filled space, and which allows fluid to flow into the filled space in the fluid and to discharge out the fluid in the filled space in the air.

8. A pump, comprising:

an impeller;

a casing which houses the impeller; and a drive source which drives and rotates the impeller, wherein the impeller includes an impeller body which rotates about a rotation axis; and a vane which is provided at the impeller body, wherein the impeller body receives force asymmetric with respect to the rotation axis in driving and rotation in a fluid in a manner that radially inward fluid force, which is generated due to arrangement of the vane, acts on a predetermined point in a peripheral direction, and a hollow space formed in the impeller body and completely surrounded by circumferential wall portions having no openings that becomes filled with fluid when the impeller is immersed in a fluid at least part of the hollow space being opposite to an outlet of the impeller such that when the impeller body is driven and rotated in the fluid, centrifugal force acting on the fluid in the filled space cancels the fluid force acting on the impeller body thereby balancing the impeller about its rotation axis when the impeller body is driven and rotated in the fluid.

9. An impeller, comprising:

an impeller body which rotates about a rotation axis; and a vane and an outlet which are provided at the impeller body, an outer channel which is recessed inward in a radial direction in an outer peripheral surface of the impeller body, has a center located on a plane orthogonal to the rotation axis of the impeller body, and peripherally extends along an outer peripheral surface of the impeller;

wherein the impeller body receives force asymmetric with respect to the rotation axis in driving and rotation in a fluid in a manner that radially inward fluid force, which is generated due to arrangement of the vane, acts on a predetermined point in a peripheral direction, a hollow space formed in the impeller body and completely surrounded by circumferential wall portions having no openings, at least part of the hollow space being opposite to the outlet and filling with fluid when the impeller body is driven and rotated in the fluid such that centrifugal force acting on the fluid filled space cancels the fluid force acting on the impeller body thereby balancing the impeller about its rotation axis when the impeller body is driven and rotated in the fluid, wherein the hollow space is opened to an end surface of the impeller body, is recessed in a direction of the rotation axis, and has a maximum depth larger than that of the outer channel at a center thereof in the direction of the rotation axis.

* * * * *